United States Patent [19]

York et al.

[11] 4,404,085

[45] Sep. 13, 1983

[54] DRYING AND DEDUSTING PROCESS

[75] Inventors: Earl D. York, Engelwood; Milton B. Thacker, Aurora; Paul B. Miller, Littleton, all of Colo.

[73] Assignee: Standard Oil Company (Indiana), Chicago, Ill.

[21] Appl. No.: 285,564

[22] Filed: Jul. 21, 1981

[51] Int. Cl.[3] ..... C10G 31/06

[52] U.S. Cl. ..... 208/11 R; 208/177

[58] Field of Search ..... 208/11 R, 127, 182, 208/177, 13, 126, 251 R; 203/88; 210/774

[56] References Cited

U.S. PATENT DOCUMENTS

| | | | |
|---|---|---|---|
| 2,952,617 | 9/1960 | Haig | 208/127 |
| 2,953,517 | 9/1960 | Whiteley et al. | 208/127 |
| 3,692,668 | 3/1971 | McCoy et al. | 208/13 X |
| 4,069,133 | 1/1978 | Unverfertn | 208/11 R |
| 4,158,622 | 6/1979 | Schwarzenbek | 208/177 |
| 4,199,432 | 4/1980 | Tamm et al. | 208/11 R X |

*Primary Examiner*—Delbert E. Gantz

*Assistant Examiner*—Glenn A. Caldarola

*Attorney, Agent, or Firm*—Thomas W. Tolpin; William T. McClain; William H. Magidson

[57] ABSTRACT

A heating and drying process for dedusting heavy oil derived from solid hydrocarbon-containing material, such as oil shale, coal or tar sand, without the use of diluents, solvents, chemical additives or mechanical separators, such as centrifuges and filters. In the process, heavy oil is fed to a dryer, such as a screw conveyor dryer or fluid bed dryer, and separated into a dedusted stream of oil and a powdery, dust-enriched residual stream. Preferably, heavy oil residue in the residual stream is combusted to leave a spent stream for use as heat carrier material in both the dryer and retort.

48 Claims, 3 Drawing Figures

HEAT CARRIER MATERIAL 48
46
50
18
14
24
LIGHT GASES
LIGHT OIL
MIDDLE OIL
DEDUSTED OIL
22
12
RETORT
RAW OIL SHALE
LIFT PIPE
32
34
26
25
30
DRYER
20
42
10
28
38
SOLIDS
40
44

LIGHT GASES
LIGHT OIL
MIDDLE OIL
36
24
HEAT CARRIER MATERIAL
18
14
34
32
22
RETORT
26
25
DEDUSTED HEAVY OIL
12
30
DRYER
52
20
42
TO LIFT PIPE
28
38
SOLIDS

DRYING AND DEDUSTING PROCESS

BACKGROUND OF THE INVENTION

This invention relates to synthetic fuels, and more particularly, to a process for dedusting heavy oil laden with dust derived from solid, hydrocarbon-containing material such as oil shale, coal and tar sand.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, stream and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in above-ground vessels or in situ retorts underground. In principle, the retorting of shale and other hydrocarbon-containing materials, such as coal and tar sand, comprise heating the solid hydrocarbon-containing material to an elevated temperature and recovering the vapors and liberated effluent. However, as medium grade oil shale yields approximately 25 gallons of oil per ton of shale, the expense of materials handling is critical to the economic feasibility of a commercial operation.

In surface retorting, oil shale is mined from the ground, brought to the surface, crushed and placed in vessels where it is contacted with a hot heat transfer carrier, such as ceramic or metal balls, hot spent shale or sand for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the reactor and recycled as heat carrier material or discarded. The combustion gases are dedusted in a cyclone or electrostatic precipitator.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushum (Manchuria), gas combustion and fluid bed. Process heat requirements for surface retorting processes may be supplied either directly or indirectly.

During fluid bed, moving bed and other types of surface retorting, decrepitation of oil shale occurs creating a popcorning effect in which particles of oil shale collide with each other and impinge against the walls of the retort forming substantial quantities of minute entrained particulates of shale dust. The use of hot spent shale or sand as heat carrier material aggravates the dust problem. Rapid retorting is desirable to minimize thermal cracking of valuable condensable hydrocarbons, but increases the rate of decrepitation and amount of dust. Shale dust is also emitted and carried away with the effluent product stream during modified in situ retorting as a flame front passes through a fixed bed of rubblized shale, as well as in fixed bed surface retorting, but dust emission is not as aggravated as in other types of surface retorting.

Shale dust ranges in size from less than 1 micron to 1000 microns and is entrained and carried away with the effluent product stream. Because shale dust is so small, it cannot be effectively removed to commercially acceptable levels by conventional dedusting equipment.

The retorting, carbonization or gasification of coal, peat and lignite and the retorting or extraction of tar sand and gilsonite create similar dust problems.

After retorting, the effluent product stream of liberated hydrocarbons and entrained dust is withdrawn from the retort through overhead lines and subsequently conveyed to a separator, such as a single or multiple stage distillation column, quench tower, scrubbing cooler or condenser, where it is separated into fractions of light gases, light oils, middle oils and heavy oils with the bottom heavy oil fraction containing essentially all of the dust. As much as 50% by weight of the bottom heavy oil fraction consists of dust.

It is very desirable to upgrade the bottom heavy oil into more marketable products, such as light oils and middle oils, but because the heavy oil fraction is laden with dust, it is very viscous and cannot be pipelined. Dust laden heavy oil plugs up hydrotreaters and catalytic crackers, gums up valves, heat exchangers, outlet orifices, pumps and distillation towers, builds up insulative layers on heat exchange surfaces reducing their efficiency and fouls up other equipment. Furthermore, the dusty heavy oil corrodes turbine blades and creates emission problems. If used as a lubricant, dusty heavy oil is about as useful as sand. Moreover, the high nitrogen content in the dusty heavy oil cannot be refined with conventional equipment.

In an effort to solve this dust problem, electrostatic precipitators have been used as well as cyclones located both inside and outside the retort. Electrostatic precipitators and cyclones, however, must be operated at very high temperatures and the product stream must be maintained at or above the highest temperature attained during the retorting process to prevent any condensation and accumulation of dust on processing equipment. Maintaining the effluent stream at high temperatures is not only expensive from an energy standpoint, but it allows detrimental side reactions, such as cracking, coking and polymerization of the effluent product stream, which tend to decrease the yield and quality of condensable hydrocarbons.

Over the years various processes and equipment have been suggested to decrease the dust concentration in the heavy oil fraction and/or upgrade the heavy oil into more marketable light oils and medium oils. Such prior art dedusting processes and equipment have included the use of cyclones, electrostatic precipitators, pebble beds, scrubbers, filters, electric treaters, spiral tubes, ebullated bed catalytic hydrotreaters, desalters, autoclave settling zones, sedimentation, gravity settling, percolation, hydrocloning, magnetic separation, electrical precipitation, stripping and binding, as well as the use of diluents, solvents and chemical additives before centrifuging. Typifying those prior art processes and equipment and related processes and equipment are those found in U.S. Pat. Nos. 2,235,639; 2,717,865; 2,719,114; 2,723,951; 2,793,104; 2,879,224; 2,899,736; 2,904,499; 2,911,349; 2,952,620; 2,968,603; 3,008,894; 3,034,979; 3,058,903; 3,252,886; 3,255,104; 3,468,789; 3,560,369; 3,684,699; 3,703,442; 3,784,462; 3,799,855; 3,808,120; 3,900,389; 3,901,791; 3,929,625; 3,974,073; 3,990,885; 4,028,222; 4,040,958; 4,049,540; 4,057,490; 4,069,133; 4,080,285; 4,088,567; 4,105,536; 4,151,073; 4,159,949; 4,162,965; 4,166,441; 4,182,672; 4,199,432; 4,220,522; 4,230,557; and 4,246,093 as well as in the articles by Rammler, R. W., *The Retorting of Coal, Oil Shale and Tar Sand By Means of Circulated Fine-Grained Heat Carriers as a Preliminary Stage in the Production of Synthetic Crude Oil,* Volume 65, Number 4, Quarterly of the Colorado School of Mines, pages 141–167 (October 1970) and Schmalfeld, I. P., *The Use of The Lurgi/Ruhrgas Process For The Distillation of Oil Shale,* Volume 70, Number 3, Quarterly of the Colorado School of Mines, pages 129–145 (July 1975). These prior art processes and equipment have not been successful in decreasing the dust concentration in the heavy oil fraction to commercially acceptable levels.

It is therefore desirable to provide an improved process, which overcomes most, if not all, of the preceding problems.

SUMMARY OF THE INVENTION

An improved process is provided for dedusting the bottom heavy oil fraction derived from solid hydrocarbon-containing material such as oil shale, coal or tar sand. In the novel process, dedusting of the heavy oil fraction is attained by heating and drying the heavy oil fraction without the use of diluents, solvents, chemical additives or mechanical separation devices such as centrifuges, filters and the like.

To this end, the heavy oil fraction is fed into a dryer, such as a screw conveyor dryer or fluid bed dryer, where it is mixed and contacted with solid heat carrier material such as hot spent hydrocarbon-containing material, sand or ceramic or metal spherical pebbles or balls, or a combination thereof, at a sufficient temperature to separate the heavy oil fraction into a purified (dedusted) stream and a powdery residual stream. The purified stream contains 80% to 100% and preferably at least 90% by weight of the heavy oil in the influent heavy oil fraction and less than 2% to 5% by weight dust. The temperature of the dryer can be controlled to coke, thermal crack and upgrade the heavy oil into lighter hydrocarbons, mainly, light oil and middle oil.

The powdery residual stream has less than 20% and preferably less than 10% by weight heavy oil and a much greater concentration of dust than the influent heavy oil fraction. Preferably, the residual stream is conveyed to a lift pipe where the heavy oil residue contained therein is combusted leaving a spent stream for use as heat carrier material in the dryer and retort. Combustion can take place in the same lift pipe in which carbon residue in the retorted material is combusted, or in another lift pipe.

The purified stream is substantially less viscous than the influent heavy oil fraction and can be safely pipelined through valves, outlet orifices, pumps, distillation columns and heat exchangers and refined in hydrotreaters and catalytic crackers.

The heavy oil fraction can be derived from in situ retorting or surface retorting, such as in a screw conveyor retort or fluid bed retort where hot spent hydrocarbon-containing material is used as solid heat carrier material to retort raw oil shale, coal or tar sand and in which the effluent product stream from the retort is separated in a single or multiple stage quench tower, scrubber or distillation column, sometimes referred to as a "fractionating column" or "fractionator," into a bottom heavy oil fraction containing as much as 25% to 50% by weight dust.

The term "dust" as used in this application means particulates derived from solid hydrocarbon-containing material and ranging in size from less than 1 micron to 1000 microns. The particulates can include retorted and raw, unretorted hydrocarbon-containing material, as well as spent hydrocarbon-containing material or sand if the latter are used as solid heat carrier material during retorting. Dust derived from the retorting of oil shale consists primarily of calcium, magnesium oxides, carbonates, silicates and silicas. Dust derived from the retorting or extraction of tar sand consists primarily of silicates, silicas and carbonates. Dust derived from the retorting, carbonization or gasification of coal consists primarily of char and ash.

The term "residual stream" as used herein means a dust-enriched residue which is formed when dust laden heavy oil is heated and dried in a dryer.

The term "spent" residual stream as used herein means a residual stream from which most, if not all, of the heavy oil contained in the residual stream has been removed by combustion.

As used throughout this application, the term "retorted" hydrocarbon-containing material or "retorted" shale refers to hydrocarbon-containing material or oil shale, respectively, which has been retorted to liberate hydrocarbons leaving an organic material containing carbon residue.

The term "spent" hydrocarbon-containing material or "spent" shale as used herein means retorted hydrocarbon-containing material or shale, respectively, from which all of the carbon residue has been removed by combustion.

The terms "normally liquid," "normally gaseous," "condensible," "condensed," or "noncondensible" are relative to the condition of the subject material at a temperature of 77° F. (25° C.) at atmospheric pressure.

A more detailed explanation of the invention is provided in the following description and appended claims taken in conjunction with the accompanying drawings.

DETAILED DESCRIPTION OF THE PREFERRED EMBODIMENTS

Figure 1:
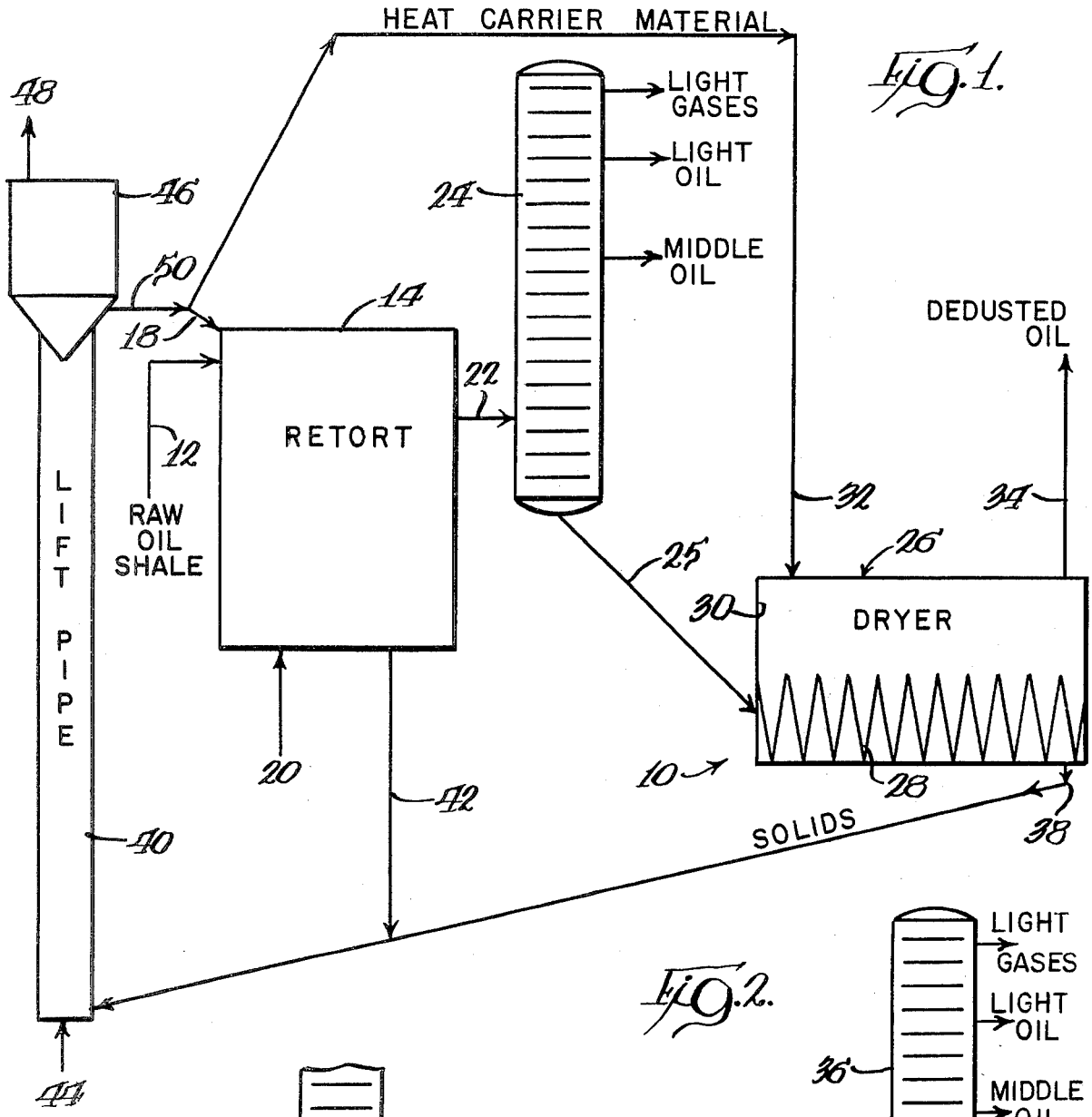
FIG. 1 is a schematic flow diagram of a process in accordance with principles of the present invention.

Referring now to FIG. 1, a drying and thermal dedusting process and system 10 is provided to dedust dust laden heavy oil derived from solid hydrocarbon-containing material, such as oil shale, coal, tar sand, uintaite (gilsonite), lignite and peat, into a purified stream of oil for use in making synthetic fuels. While the process of the present invention is described hereinafter with particular reference to the processing of oil shale, it will be apparent that the process can also be used in connection with the processing of other hydrocarbon-containing materials, such as coal, tar sand, uintaite (gilsonite), lignite, peat, etc.

In process and system 10, raw, fresh oil shale, which preferably contains an oil yield of at least 15 gallons per ton of shale particles, is crushed and sized to a maximum fluidizable size of 10 mm and fed through raw shale inlet line 12 at a temperature from ambient temperature to 600° F. into fluid bed retort 14, also referred to as a "fluidized bed retort." The fresh oil shale can be crushed by conventional crushing equipment such as an impact crusher, jaw crusher, gyratory crusher or roll crusher and screened with conventional screening equipment, such as a shaker screen or a vibrating screen.

Spent oil shale and spent residual stream, which together provide solid heat carrier material, are fed together through heat carrier line 18 at a temperature from 1000° F. to 1400° F., preferably from 1200° F. to 1300° F., into retort 14 to mix with, heat and retort raw oil shale in retort 14. A fluidizing lift gas such as light hydrocarbon gases or other gases which do not contain an amount of molecular oxygen sufficient to support combustion, is injected into the bottom of retort 14 through a gas injector 20 to fluidize, entrain and enhance mixing of the raw oil shale and solid heat carrier material in retort 14. The retorting temperature of retort 14 is from 850° F. to 1000° F., and preferably from 900° F. to 960° F. at atmospheric pressure.

During retorting, hydrocarbons are liberated from the raw oil shale as a gas, vapor, mist or liquid droplets and most likely a mixture thereof along with entrained particulates of oil shale dust ranging in size from less than 1 micron to 1000 microns.

The mixture of liberated hydrocarbons and entrained particulates is discharged from the upper portion of retort 14 through product line 22 and conveyed to a separator 24, such as a quench tower or fractionating column. The effluent mixture can be partially dedusted in a cyclone (not shown) before being fed into separator 24. The effluent product stream of liberated hydrocarbons and entrained particulates is separated in quench tower or fractionating column 24 into fractions of light gases, light shale oils, middle shale oils and heavy shale oils. The solids bottom heavy shale oil fraction is recovered at the bottom of separator 24. Heavy shale oil has a boiling point over 600° F. to 800° F. Middle shale oil has a boiling point over 400° F. to 500° F. and light shale oil has a boiling point over 100° F.

The solids bottom heavy shale oil fraction is a slurry that contains from 15 percent to 35 percent by weight of the effluent product stream. The slurry, which is also referred to as "dust laden heavy oil" or "dusty oil," consists essentially of normally liquid heavy shale oil and from 1 percent to 50 percent by weight and preferably at least 25 percent by weight entrained oil shale particulates. The temperature in separator 24 can be varied from 500° F. to 800° F. and preferably to a maximum temperature of 600° F. at atmospheric pressure to assure that essentially all the oil shale particulates gravitate to and are entrained in the solids bottom heavy oil fraction.

The dust laden heavy oil is discharged from the bottom of separator 24 through heavy oil discharge line 25 where it is fed at the discharge temperature of separator 24 into a screw conveyor dryer or heater 26. Dryer 26 has twin horizontal mixing screws 28 and an overhead vapor collection hood 30 which provides a dust settling area and disentrainment space. Screws 28 operate in the range from 10 rpm to 100 rpm and preferably from 20 rpm to 30 rpm. A dryer with a single screw can also be used.

Spent oil shale and the spent residual stream, which together provide solid heat carrier material, are fed together through heat carrier line 32 into dryer 26 at a temperature from 800° F. to 1400° F. and preferably at about 1200° F. The solid heat carrier material provides the source of heat for dryer 26.

Screw conveyor dryer 26 mixes the dust laden heavy oil and heat carrier material together at a heating temperature from 400° F. to 950° F., preferably from 700° F. to 900° F. and most preferably about 900° F. The solids flux feed rate ratio of dust laden heavy oil to heat carrier material being fed into dryer 26 is from 2:1 to 7:1 and preferably from 3:1 to 5:1.

In dryer 26, the dust laden heavy shale oil is heated, dried and separated into a dedusted purified stream of normally liquid heavy shale oil containing less than 5 percent and preferably less than 2 percent by weight shale dust leaving a powdery residual stream. From 80 percent to 100 percent and preferably at from 90 percent to 95 percent by weight of the normally liquid heavy shale oil in the dusty oil fraction is separated into the purified stream. The dust laden heavy shale oil can be coked and thermal cracked into lighter hydrocarbons, mainly, normally liquid light shale oil and normally liquid middle shale oil, in dryer 26.

The solids residence time in dryer 26 is from 0.5 minutes to 120 minutes and preferably from 10 minutes to 30 minutes. Dryer 26 operates at a pressure from a few inches water vacuum (−5 inches $H_2O$ or −0.18 psig) to 150 psig and preferably at atmospheric pressure.

Figure 2:
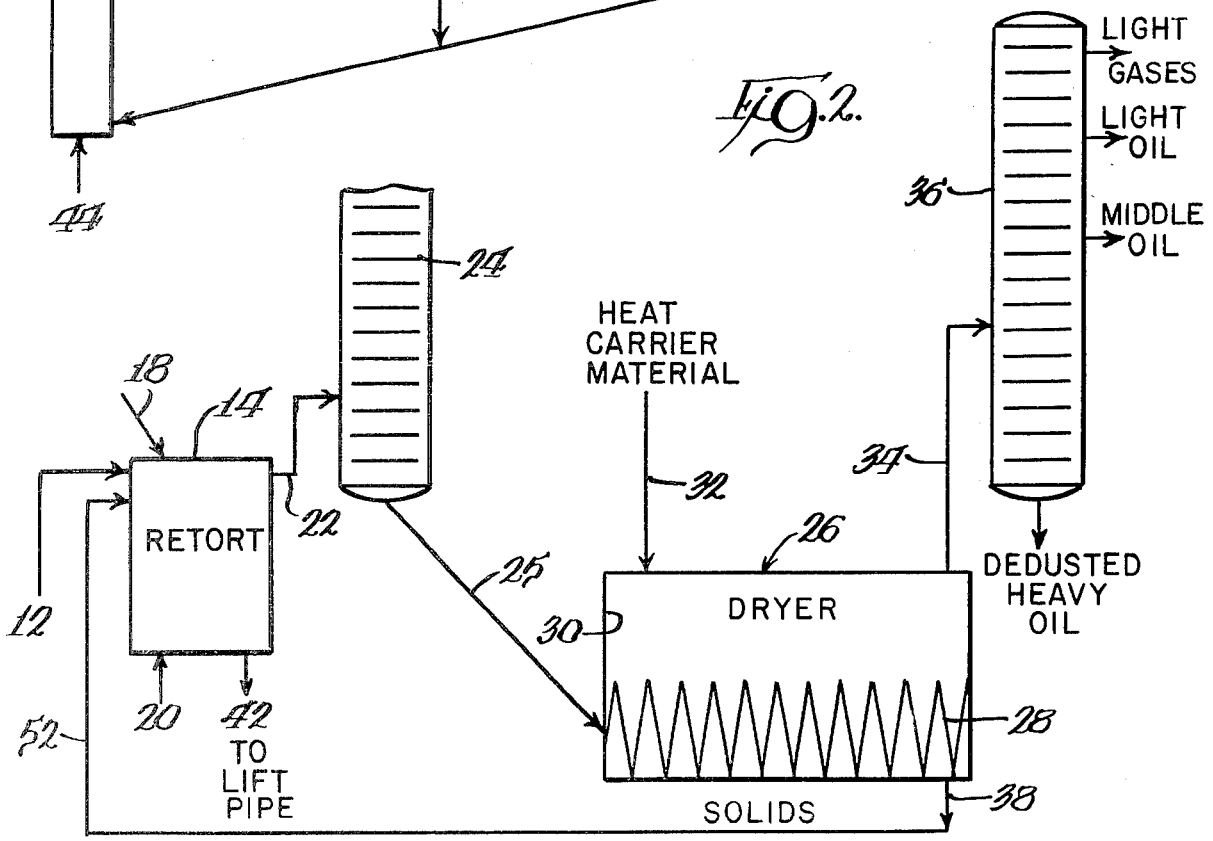
FIG. 2 is an alternative embodiment of part of the process.

The purified stream of oil is withdrawn from dryer 26 through overhead line 34 for upgrading and further processing. Alternatively, the purified stream can be fed to another quench tower or fractionating column 36 as shown in FIG. 2 before further upgrading and processing.

The powdery residual stream and solid heat carrier material in dryer 26 are discharged from the bottom of dryer 26 through residue line 38 where they are conveyed and fed to the bottom of a vertical lift pipe 40 (FIG. 1) by conveying means, such as a vibrating solid conveyor, pneumatic conveyor or screw conveyor.

Retorted shale and solid heat carrier material from retort 14 are discharged through the bottom of retort 14 into discharge line 42 where they are fed and mixed with the residual stream and heat carrier material from the dryer 26. Alternatively, the residual stream heat carrier material from dryer 26 can be fed into retort 14 via inlet line 52 as shown in FIG. 2 and subsequently discharged through the bottom of retort 14, along with retorted shale and heat carrier material.

The residual stream, retorted shale and heat carrier material are fed together into the bottom portion of lift pipe 40 (FIG. 1) where they are fluidized, entrained, propelled and conveyed upwardly through the lift pipe into a collection and separation bin 46, also referred to as a "collector," by air injected into the bottom of lift pipe 40 through air injector nozzle 44. Carbon residue in the retorted shale as well as heavy shale oil and any carbon residue in the residual stream are combusted in lift pipe 40 to heat the heat carrier material to a temperature from 1000° F. to 1400° F. and preferably from 1200° F. to 1300° F. The combusted retorted shale and combusted residual stream form hot spent oil shale and a hot spent residual stream, respectively, for use as solid heat carrier material in dryer 26 and retort 14. The spent material is discharged from the bottom of separation bin 46 through heat carrier line 50. Part of the heat carrier material in heat carrier line 50 is fed into retort 14 via heat carrier line 18 and part of the heat carrier material in heat carrier line 50 is fed to dryer 26 via heat carrier line 32. Combustion gases are withdrawn from the top of separation bin 46 through combustion gas line 48 and dedusted in a cyclone or electrostatic precipitator for discharge into the atmosphere or further processing.

Figure 3:
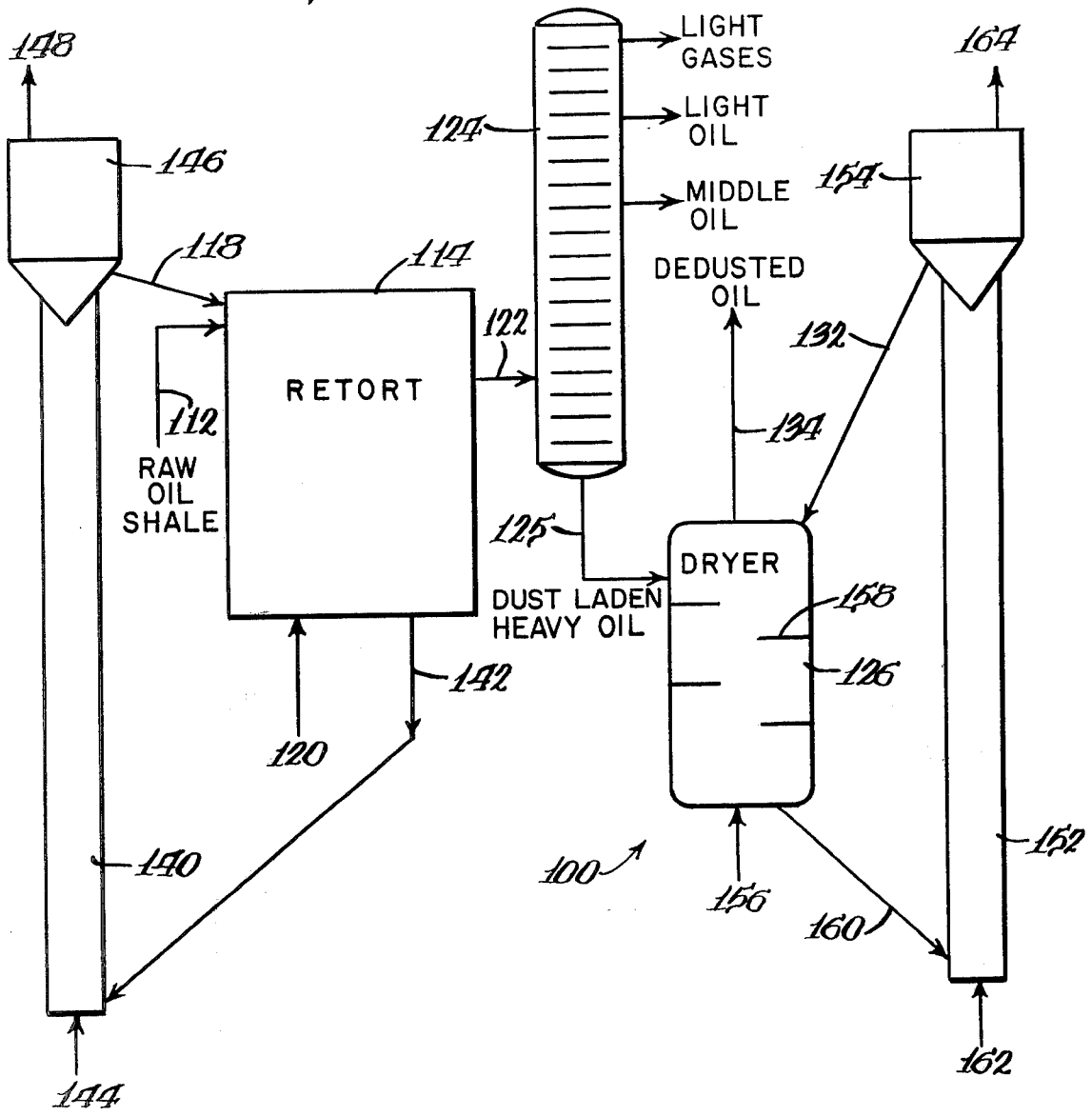
FIG. 3 is a schematic flow diagram of another process in accordance with principles of the present invention.

The drying and thermal dedusting process and system 100 shown in FIG. 3 is similar to the drying and thermal dedusting process and system 10 shown in FIG. 1, except that a fluid or fluidizing bed dryer or heater 126 is used instead of a screw conveyor dryer. Furthermore, in the illustrated process and system 100 (FIG. 3) the powdery residual stream and heat carrier material from the dryer are conveyed and combusted in a second vertical lift pipe 152, although in some circumstances it may be desirable to combust the residual stream, retorted shale and heat carrier material in the same lift pipe as in FIG. 1. For ease of understanding and for clarity, similar parts and components of process and system 100 (FIG. 3) have been given part numbers similar to corresponding parts and components in process and system 10 (FIG. 1) except in the 100 series, such as retort 14, separator 124, etc.

In process and system 100 (FIG. 3), the dust laden heavy shale oil fraction is withdrawn from the bottom of quench tower or fractionating column 124 through heavy oil discharge line 125 and fed to an upper portion of fluid bed dryer 126 at the discharge temperature of separator 124. Hot spent residual stream from the bottom of a second collection and separation bin 154, also referred to as the second "collector," is fed through dryer inlet line 132 into the top of fluid bed dryer 126 at a temperature from 800° F. to 1400° F. and preferably at about 1200° F. The solids flux feed rate ratio of dusty oil to heat carrier material fed into fluid bed dryer 126 is from 2:1 to 7:1 and preferably from 3:1 to 5:1. The hot spent, residual stream provides the solid heat carrier material and the source of heat for fluid bed dryer 126. The heat carrier material in dryer 126 can be supplemented by hot spent oil shale or sand.

The heavy shale oil fraction and heat carrier material move downwardly by gravity flow into the bottom of fluid bed retort 126 in countercurrent flow to the lift gas. A staggered array of horizontal baffles or internals 158 can be provided in fluid bed dryer 126 to enhance mixing, heating and drying of the dusty oil fraction and heat carrier material.

A lift gas, preferably light gases from fractionating column 124, is injected into the bottom of fluid bed dryer 126 through lift gas injection nozzle 156 to fluidize, entrain and mix the dust laden heavy shale oil fraction and heat carrier material together in dryer 126. The lift gas should not contain a sufficient amount of molecular oxygen to support combustion.

In fluid bed dryer 126, the dust laden heavy shale oil fraction is heated, dried and separated into a dedusted purified stream of normally liquid heavy shale oil containing less than 5 percent and preferably less than 2 percent by weight shale dust, leaving a powdery residual stream. From 80 percent to 100 percent and preferably from 90 percent to 95 percent by weight of the normally liquid heavy shale oil in the dusty oil fraction is separated into the purified stream. The dust laden heavy shale oil can be coked and thermal cracked into lighter hydrocarbons, mainly, normally liquid light shale oil and normally liquid middle shale oil, in dryer 126.

Dryer 126 operates at a heating temperature from 400° F. to 950° F., preferably from 700° F. to 900° F. and most preferably at 900° F. The pressure in fluid bed dryer 126 is from a few inches water vacuum (−5 inches $H_2O$ or −0.18 psig) to 150 psig and preferably at atmospheric pressure. The solids residence time in fluid bed dryer 126 is from 0.5 minutes to 120 minutes and preferably from 10 minutes to 30 minutes.

The purified stream of oil is propelled by the lift gas out of the top of fluid bed dryer 126 through an overhead line 134 for upgrading and further processing. Alternatively, the purified stream can be fed to another quench tower or fractionating column for further upgrading and processing.

The powdery residual stream and solid heat carrier material in dryer 126 are discharged from the bottom of dryer 126 through residue line 160 where they are conveyed by gravity flow or conveying means, such as a vibrating solid conveyor or pneumatic conveyor, to the lower portion of a second lift pipe 152. Air is injected into the bottom of second lift pipe 152 through air injection nozzle 162 to fluidize, entrain, convey and propel the residual stream and heat carrier material upwardly through the second lift pipe 152 into a second separation and collection bin 154. Heavy shale oil and any carbon residue contained in the residual stream are combusted in lift pipe 152 leaving a spent residual stream for use as heat carrier material in dryer 126.

Combustion gases are withdrawn from the top of separation bin 154 through combustion gas line 164 and dedusted in a cyclone or electrostatic precipitator for discharge to the atmosphere or further processing.

Among the many advantages of the above processes are:

(1) Improved of product yield.

(2) Better dedusting of the bottom heavy oil fraction.

(3) Lower product viscosity.

(4) Ability to pipeline the dedusted heavy shale oil through valves, outlet orifices, heat exchangers, pumps and distillation towers and refine the dedusted heavy oil in hydrotreaters and catalytic crackers.

While the retort shown in the preferred embodiment is a fluid bed retort, other retorts can be used such as a screw conveyor retort followed by a surge bin or a rotating pyrolysis drum followed by an accumulator. Metal or ceramic balls can also be used as solid heat carrier material with the lift pipe serving as a ball heater. Sand can also be used as solid heat carrier material. Furthermore, while it is preferred to heat the solid hydrocarbon-containing material in the dryer by directly contacting the solid hydrocarbon-containing material with solid heat carrier material, it may be desirable in some circumstances to indirectly heat the solid hydrocarbon-containing material or heat the solid hydrocarbon-containing material with a gaseous heat carrier material.

Although embodiments of this invention have been shown and described, it is to be understood that various modifications and substitutions, as well as rearrangements and combinations of process steps, can be made by those skilled in the art without departing from the novel spirit and scope of this invention.

What is claimed is:

1. A process for dedusting particulate laden oil derived from solid hydrocarbon-containing material, comprising the steps of:

feeding particulate laden heavy oil derived from solid hydrocarbon-containing material into a screw conveyor dryer;

feeding solid heat carrier material into said screw conveyor dryer; and heating said particulate laden heavy oil in said screw conveyor dryer by contacting said solid hydrocarbon-containing material with said solid heat carrier material at a sufficient heating temperature in said screw conveyor dryer to separate said particulate laden heavy oil into a dedusted stream of hydrocarbons containing a substantially lower concentration of particulates than said particulate laden heavy oil and a residual stream containing a higher concentration of particulates than said particulate laden heavy oil.

2. A process in accordance with claim 1 wherein said solid hydrocarbon-containing material is selected from the group consisting of oil shale, tar sand, coal, lignite, peat and uintaite.

3. A process in accordance with claim 1 wherein said solid heat carrier material is selected from the group consisting of a combusted residual stream, spent hydrocarbon-containing material, sand, ceramic balls and metal balls.

4. A process in accordance with claim 1 wherein said particulates are selected from the group consisting of raw, unretorted and spent hydrocarbon-containing material.

5. A process in accordance with claim 1 wherein said particulates are selected from the group consisting of calcium, magnesium oxides, carbonates, silicates, silicas, char and ash.

6. A process in accordance with claim 1 wherein said dedusted stream consists essentially of normally liquid heavy oil and less than 5% by weight particulates.

7. A process in accordance with claim 6 wherein said dedusted stream contains less than 2% by weight particulates.

8. A process in accordance with claim 1 wherein said particulate laden heavy oil is thermal cracked in said dryer into a dedusted stream of normally liquid heavy oil and lighter hydrocarbons containing less than 5% by weight particulates.

9. A process in accordance with claim 8 wherein said lighter hydrocarbons consist of normally liquid middle oil and normally liquid light oil and said dedusted stream contains less than 2% by weight particulates.

10. A process in accordance with claim 1 wherein said particulate laden heavy oil is derived from in situ retorting of said solid hydrocarbon-containing material.

11. A process in accordance with claim 1 wherein said particulate laden heavy oil is derived from surface retorting of said solid hydrocarbon-containing material.

12. A process in accordance with claim 1 wherein said residual stream contains a maximum of 10% by weight normally liquid heavy oil.

13. A process in accordance with claim 1 wherein from 80% to 100% of said normally liquid heavy oil in said particulate laden heavy oil is separated in said dryer into said dedusted stream.

14. A process in accordance with claim 13 wherein at least 90% of said normally liquid oil in said particulate laden heavy oil is separated in said dryer into said dedusted stream.

15. A process in accordance with claim 1 wherein said particulate laden heavy oil is coked in said dryer and said residual stream contains carbon residue from said coking.

16. A process in accordance with claim 1 wherein said residual stream is removed from said dryer and combusted for use as part of said solid heat carrier material.

17. A process in accordance with claim 16 wherein said residual stream is combusted in a lift pipe.

18. A process in accordance with claim 1 wherein said screw conveyor dryer has twin screws and an overhead collection hood defining a dust settling area nd disentrainment space.

19. A process for dedusting heavy shale oil, comprising the steps of:

feeding particulate laden heavy shale oil consisting essentially of normally liquid heavy shale oil having a boiling point over 600° F. and from 1% to 50% by weight entrained shale particulates ranging in size from 1 micron to 1000 microns to a fluid bed dryer;

feeding solid heat carrier material comprising spent oil shale particulates to said fluid bed dryer at a temperature from 800° F. to 1400° F.;

injecting a lift gas in the absence of a sufficient amount of oxygen to support combustion into said fluid bed dryer to fluidize, entrain and mix said particulate laden oil shale and said solid heat carrier material for a sufficient time to separate from 80% to 100% by weight of said particulate laden heavy shale oil into a dedusted stream of normally liquid heavy shale oil containing less than 5% by weight shale particulates leaving a residual stream of shale particulates containing a maximum of 20% by weight normally liquid heavy shale oil;

feeding said residual stream to a combustor;

combusting said residual stream in said combustor to form said spent oil shale particulates; and recycling said spent oil shale particulates to said fluid bed dryer for use as said solid heat carrier material.

20. A process in accordance with claim 19 wherein said oil shale particulates which have been separated in said dryer and combusted in said combustor are fed to a screw conveyor retort for use in retorting raw oil shale in said screw conveyor retort.

21. A process in accordance with claim 19 wherein oil shale particulates which have been separated in said dryer and combusted in said combustor are fed to a fluid bed retort for use in retorting raw oil shale in said fluid bed retort.

22. A process in accordance with claim 19 wherein said particulate laden heavy shale oil has at least 25% by weight of said entrained shale particulates.

23. A process in accordance with claim 19 wherein at least 90% by weight of said heavy shale oil in said particulate laden oil is dedusted and recovered in said dedusted stream.

24. A process in accordance with claim 19 wherein said dedusted stream contains less than 2% by weight shale particulates.

25. A process in accordance with claim 19 wherein the solids flux feed rate ratio of particulate laden heavy oil to solid heat carrier material is from 2:1to 7:1 and said time is in the range from 0.5 minutes to 120 minutes.

26. A process in accordance with claim 25 wherein said solids flux feed rate ratio is from 3:1 to 5:1, and said time is in the range from 10 minutes to 30 minutes.

27. A process in accordance with claim 19 wherein said combustor is a lift pipe and said residual stream is conveyed upwardly and combusted in said lift pipe.

28. A process in accordance with claim 19 wherein some of said heavy shale oil in said dedusted stream is thermal cracked in said dryer into normally liquid middle shale oil and normally liquid light shale oil.

29. A process for dedusting heavy shale oil, comprising the steps of:

feeding the particulate laden heavy shale oil consisting of normally liquid heavy shale oil having a boiling point over 600° F. and from 25% to 50% by weight shale particulates ranging in size from 1 micron to 1000 microns to a screw conveyor dryer;

feeding solid heat carrier material into said screw conveyor dryer at a temperature from 800° F. to 1400° F.; and mixing said particulate laden heavy shale oil and said solid heat carrier material at a mixing temperature of 400° F. to 950° F. for a sufficient time to separate from 80% to 100% by weight of said particulate laden heavy oil into a dedusted stream of normally liquid heavy oil containing less than 5% by weight shale particulates leaving a residual stream containing a maximum of 20% by weight normally liquid heavy shale oil.

30. A process in accordance with claim 29 wherein said screw conveyor dryer has twin screws and an overhead collection head and said screws mix said particulate laden heavy oil shale and said solid heat carrier material at 10 rpm to 100 rpm.

31. A process in accordance with claim 30 wherein said screws mix said particulate laden heavy oil and said solid heat carrier material at 20 rpm to 30 rpm.

32. A process in accordance with claim 29 wherein said mixing temperature is from 700° F. to 900° F.

33. A process in accordance with claim 29 wherein said time is in the range of from 0.5 minutes to 120 minutes.

34. A process in accordance with claim 29 wherein said time is in the range from 10 minutes to 30 minutes.

35. A process in accordance with claim 29 wherein at least 90% by weight of said heavy shale oil in said particulate laden oil is dedusted and recovered in said dedusted stream.

36. A process in accordance with claim 29 wherein said dedusted stream contains less than 2% by weight shale particulates.

37. A process in accordance with claim 29 wherein the solids flux feed rate ratio of particulate laden heavy oil to solid heat carrier material is from 2:1 to 7:1.

38. A process in accordance with claim 37 wherein said solids flux feed rate ratio is from 3:1 to 5:1.

39. A process in accordance with claim 29 wherein said residual stream is combusted in a lift pipe for use as part of said heat carrier material.

40. A process in accordance with claim 29 wherein some of said heavy shale oil in said dedusted stream is thermal cracked in said dryer into normally liquid middle shale oil and normally liquid light shale oil.

41. A process in accordance with claim 29 wherein said dryer is operated at a pressure from −5 inches of water to 150 psig.

42. A process in accordance with claim 29 wherein said dryer is operated at atmospheric pressure.

43. A process for producing and dedusting shale oil, comprising the steps of:

(a) introducing raw oil shale having a maximum size of 10 mm into a retort;

(b) introducing spent oil shale into said retort;

(c) introducing a spent residual stream into said retort;

(d) mixing said raw oil shale, spent oil shale and said spent residual stream in said retort at a retorting temperature to liberate an effluent stream of hydrocarbons and entrained shale particulates ranging in size from less than 1 micron to 1000 microns;

(e) separating a 15% to 35% fraction by weight of said effluent stream in a separator, said fraction consisting essentially of normally liquid heavy shale oil having a boiling point over 600° F. and from 25% to 50% by weight of said shale particulates;

(f) feeding said fraction into a screw conveyor dryer at a location spaced from said retort;

(g) feeding said spent oil shale to said screw conveyor dryer;

(h) feeding said spent residual stream to said screw conveyor dryer;

(i) heating said fraction in said screw conveyor dryer by mixing said fraction with said spent shale and said spent residual stream at a sufficient temperature in said dryer to separate from 80% to 100% by weight of said normally liquid heavy shale oil in said fraction into a purified stream of normally liquid shale oil containing less than 5% by weight of said shale particulates, leaving a residual stream containing a maximum of 20% by weight normally liquid heavy shale oil and a higher concentration of said shale particulates than said fraction;

(j) withdrawing said purified stream from said screw conveyor dryer;

(k) removing said retorted shale, spent shale and spent residual stream from said retort;

(l) feeding said removed material to a lift pipe;

(m) injecting air into said lift pipe to fluidize, entrain, combust and propel said removed material upwardly through said lift pipe to a separation bin to heat the removed material and combust said retorted shale to form spent oil shale for steps (b) and (g);

(n) removing said residual stream, along with said spent residual stream and said spent oil shale, from said screw conveyor dryer; and (o) combusting said residual stream removed from said screw conveyor dryer in step (n) to heat said material removed from said screw conveyor dryer and form a spent residual stream for steps (c) and (h).

44. A process in accordance with claim 43 wherein the material removed from said screw conveyor dryer in step (n) is fed into said lift pipe and fluidized, entrained, combusted and propelled upwardly through said lift pipe to said separation bin simultaneously with step (m).

45. A process in accordance with claim 43 wherein at least 90% of said normally liquid heavy shale oil in said fraction is dedusted and recovered in said purified stream.

46. A process in accordance with claim 45 wherein said purified stream contains less than 2% by weight of said shale particulates.

47. A process in accordance with claim 19 wherein:

said lift gas is injected generally upwardly into the bottom portion of said fluid bed dryer; and said particulate laden shale oil and said solid heat carrier material are fed into the upper portion of said fluid bed dryer and move generally downwardly by gravity flow towards the bottom portion of said fluid bed dryer in countercurrent flow to said lift gas.

48. A process for dedusting particulate laden oil derived from solid hydrogen-containing material, comprising the steps of:

feeding particulate laden heavy oil derived from solid hydrocarbon-containing material into a fluid bed dryer;

feeding solid heat carrier material into said fluid bed dryer; and heating said particulate laden heavy oil in said fluid bed dryer by contacting said solid hydrocarbon-containing material with said solid heat carrier material at a sufficient heating temperature in said fluid bed dryer to separate said particulate laden heavy oil into a dedusted stream of hydrocarbons containing a substantially lower concentration of particulates than said particulate laden heavy oil and a residual stream containing a higher concentration of particulates than said particulate laden heavy oil.

* * * * *

UNITED STATES PATENT OFFICE
CERTIFICATE OF CORRECTION

Patent No. 4,404,085 Dated September 13, 1983

Inventor(s) YORK, EARL D.; THACKER, MILTON B. AND MILLER, PAUL B.

It is certified that error appears in the above-identified patent and that said Letters Patent are hereby corrected as shown below:

Item [73], "Assignee: Standard Oil Company
Chicago, Ill."
should be

--Assignees: Standard Oil Company
Chicago, Ill. and Gulf Oil Corporation,
Pittsburgh, Pa.--

Column 1, line 45, "stream" should read --steam--
Column 7, line 56, "14" should read --114--
Column 10, line 42, "nd" should read --and--
Column 14, line 10, "hydrogen" should read --hydrocarbon--

Signed and Sealed this

*Twenty-first* Day of *February 1984*

[SEAL]

*Attest:*

GERALD J. MOSSINGHOFF

*Attesting Officer*

*Commissioner of Patents and Trademarks*